US008917232B2

(12) United States Patent
Suzuki

(10) Patent No.: US 8,917,232 B2
(45) Date of Patent: Dec. 23, 2014

(54) DISPLAY APPARATUS AND CONTROL METHOD THEREOF

(75) Inventor: Noriaki Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 13/451,194

(22) Filed: Apr. 19, 2012

(65) Prior Publication Data

US 2012/0274677 A1 Nov. 1, 2012

(30) Foreign Application Priority Data

Apr. 26, 2011 (JP) ..... 2011-098098
Jan. 25, 2012 (JP) ..... 2012-013162

(51) Int. Cl.
*G09G 3/36* (2006.01)
*G09G 3/34* (2006.01)

(52) U.S. Cl.
CPC ..... *G09G 3/3426* (2013.01); *G09G 2310/0237* (2013.01); *G09G 2330/021* (2013.01)
USPC ..... 345/102

(58) Field of Classification Search
USPC ..... 345/102
See application file for complete search history.

(56) References Cited

U.S. PATENT DOCUMENTS 6,556,181 B2 * 4/2003 Yamada et al. ..... 345/88
2005/0134543 A1 6/2005 Kim
2006/0164369 A1 * 7/2006 Park ..... 345/98

FOREIGN PATENT DOCUMENTS

CN 101374380 A 2/2009
JP 03-092820 A 4/1991
JP 2005-229353 8/2005
JP 2005-229353 A 8/2005

OTHER PUBLICATIONS

Feb. 26, 2014 Chinese Office Action, which is enclosed with an English Translation, that issued in Chinese Patent Application No. 201210127459.9.

* cited by examiner

*Primary Examiner* — Chanh Nguyen
*Assistant Examiner* — Roy Rabindranath
(74) *Attorney, Agent, or Firm* — Cowan, Liebowitz & Latman, P.C.

(57) ABSTRACT

A display apparatus according to the present invention comprises a display panel having a transmittance that can be changed for each frame of an input video signal, an adjusting unit that adjusts a timing at which the transmittance of the display panel changes, and a backlight unit that emits light in a period corresponding to a period of an applied alternating-current voltage, wherein the adjusting unit adjusts the timing at which the transmittance of the display panel changes on the basis of the period of the alternating-current voltage.

8 Claims, 8 Drawing Sheets

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

In a recently proposed method for improving a light emission efficiency of a light source that emits light using a commercial alternating current power supply, alternating current/direct current conversion and direct current/voltage conversion are not performed, and instead, a plurality of LEDs connected in series are driven to emit light using an alternating-current voltage as is, thereby reducing loss occurring during the respective conversions. The alternating current-driven LEDs emit light in a period of the alternating-current voltage.

In a display apparatus including a backlight, a power consumption of the backlight occupies a large proportion of an overall power consumption of the display apparatus. Therefore, the overall power consumption of the display apparatus can be reduced by reducing the power consumption of the backlight. By subjecting a light source of the backlight to alternating current driving, the power consumption can be reduced greatly.

However, when the light source of the backlight is subjected to alternating current driving, a frame rate of a video signal and a light emission period of the backlight become asynchronous, and therefore, as shown in FIG. 8, the backlight may emit light during a transmittance transition period (a shaded portion of the drawing) of a liquid crystal panel. When the backlight emits light during this transition period, sharp video display is impaired. More specifically, a double image consisting of front and rear frames is displayed, and therefore motion blurring occurs during display of a moving image.

Meanwhile, an image pickup apparatus that detects flicker using a flicker detecting light source and controls an image pickup frame rate and a flicker index value detection period when flicker is detected has been proposed in the related art (see Japanese Patent Application Publication No. 2005-229353, for example).

SUMMARY OF THE INVENTION

However, the technique disclosed in Japanese Patent Application Publication No. 2005-229353 is merely a technique for controlling a frame rate read from an imaging device, and the problem described above cannot be solved by applying the technique disclosed in Japanese Patent Application Publication No. 2005-229353 to a display apparatus in which a light source of a backlight is subjected to alternating current driving.

The present invention provides a technique with which a sharp video can be displayed with low power consumption.

A display apparatus according to the present invention comprises:

a display panel having a transmittance that can be changed for each frame of an input video signal;

an adjusting unit that adjusts a timing at which the transmittance of the display panel changes; and a backlight unit that emits light in a period corresponding to a period of an applied alternating-current voltage, wherein the adjusting unit adjusts the timing at which the transmittance of the display panel changes on the basis of the period of the alternating-current voltage.

A control method, according to the present invention, for a display apparatus that includes a display panel, and a backlight unit that emits light in a period corresponding to a period of an applied alternating-current voltage, the control method comprises the steps of:

changing, for each frame of an input video signal, a transmittance of the display panel to a transmittance corresponding to the frame; and adjusting a timing at which the transmittance of the display panel changes on the basis of the period of the alternating-current voltage.

According to the present invention, a sharp video can be displayed with low power consumption.

Further features of the present invention will become apparent from the following description of exemplary embodiments with reference to the attached drawings.

DESCRIPTION OF THE EMBODIMENTS

First Embodiment

A display apparatus and a control method thereof according to a first embodiment of the present invention will be described below.

Figure 1:
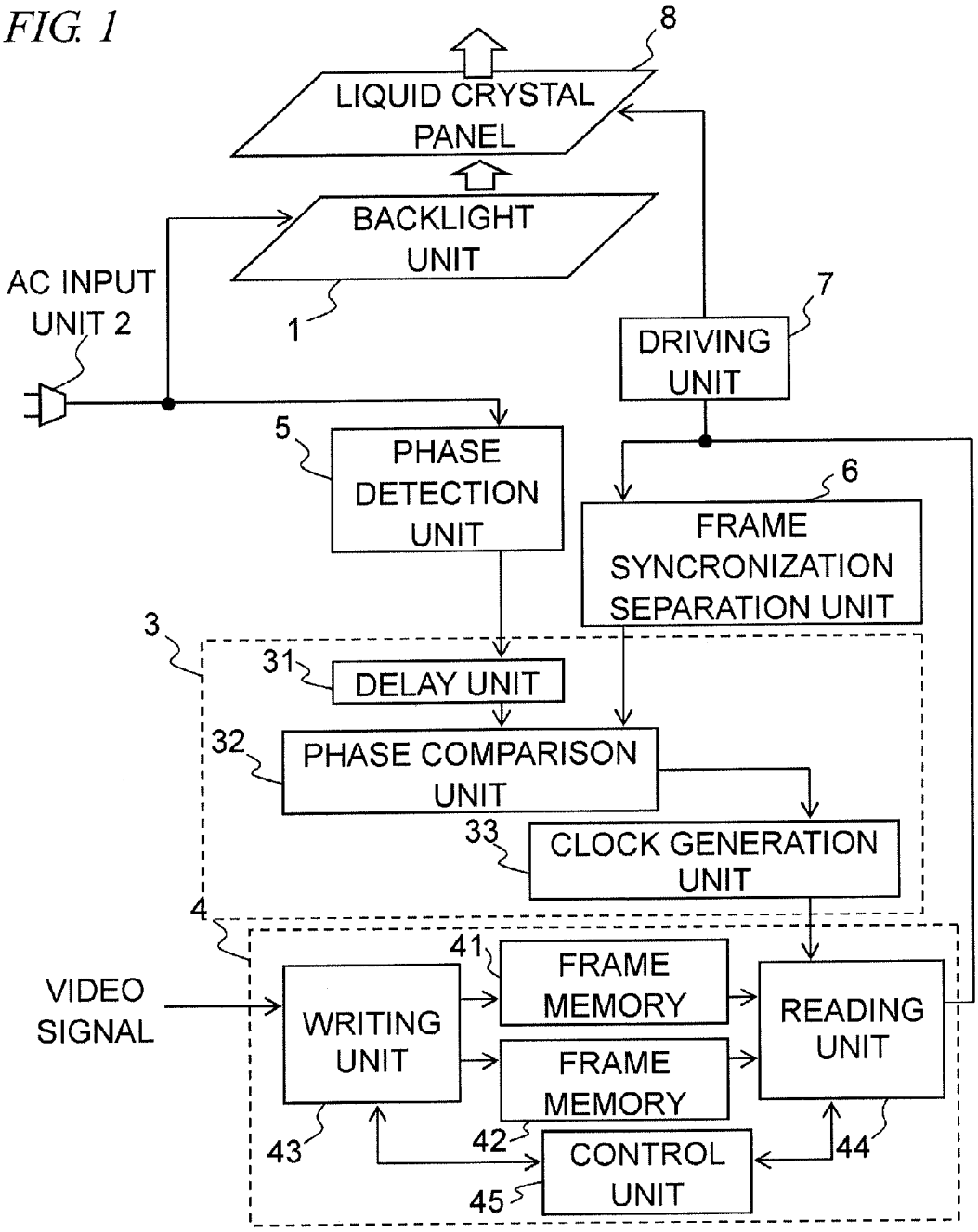
FIG. 1 is a block diagram showing a display apparatus according to first and second embodiments.

FIG. 1 is a block diagram showing an example of a functional configuration of the display apparatus according to this embodiment.

Figure 2:
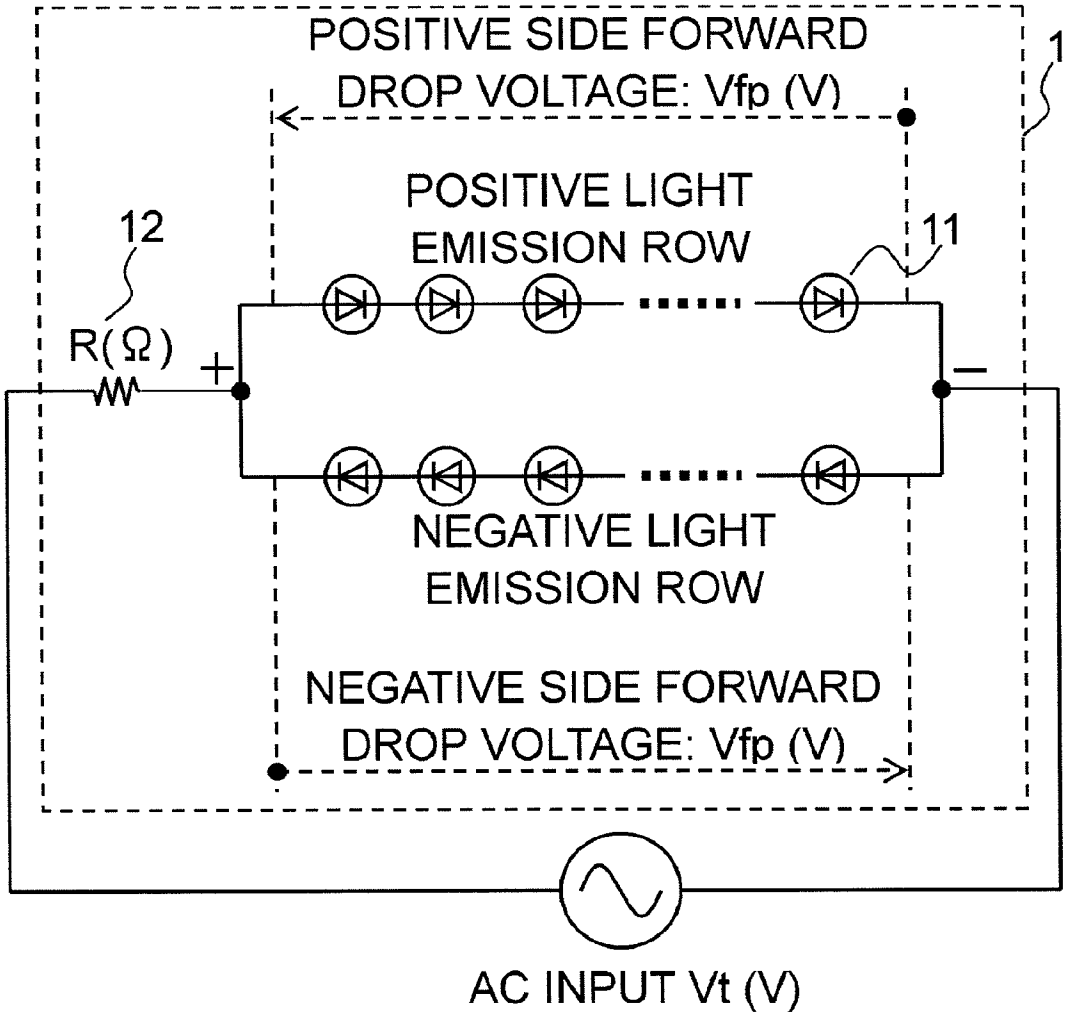
FIG. 2 is a schematic circuit diagram of a backlight unit according to the first embodiment.

FIG. 2 is a schematic circuit diagram showing an example of a circuit configuration of a backlight unit provided in the display apparatus according to this embodiment.

Figure 3:
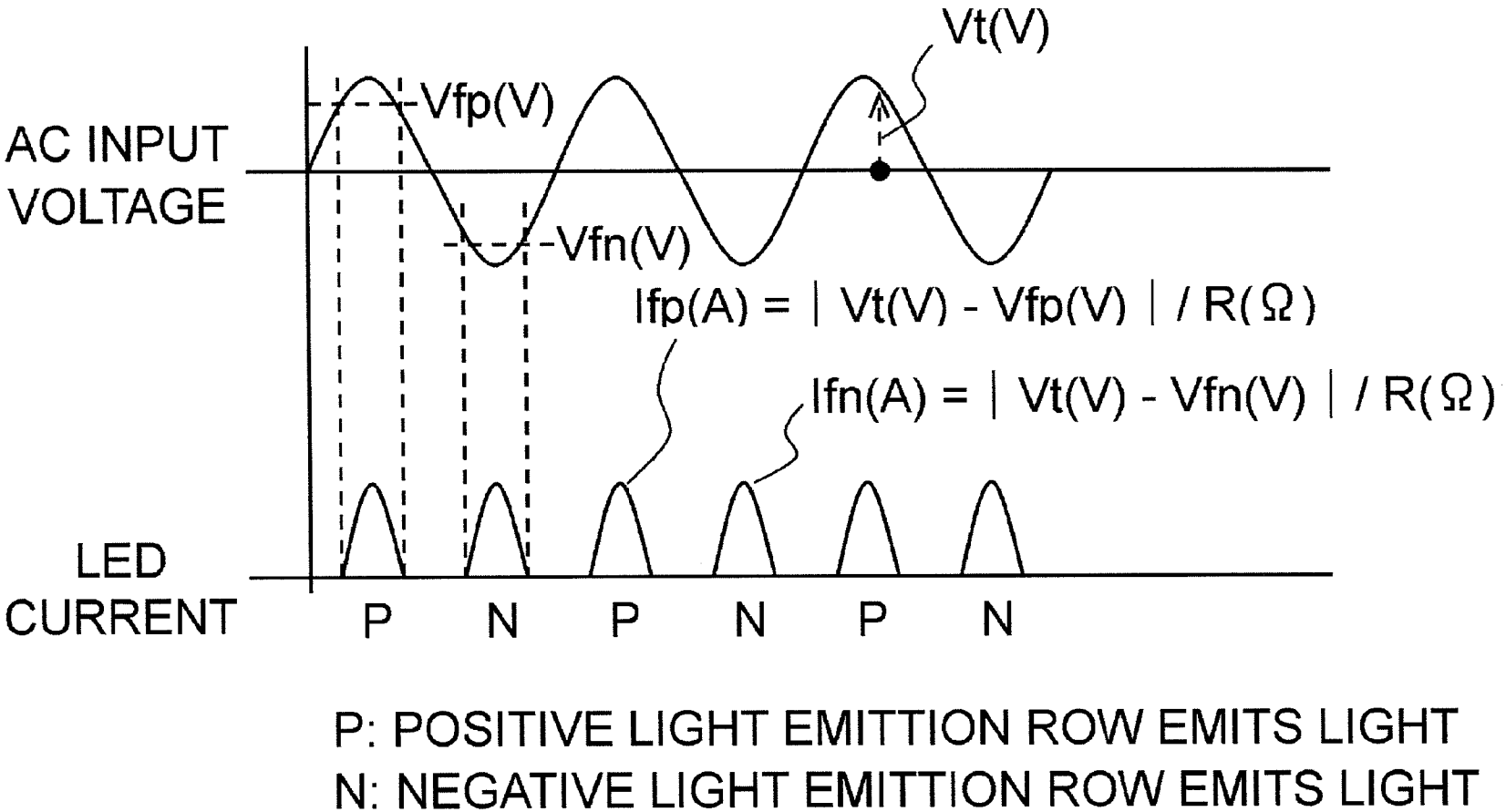
FIG. 3 is a light emission waveform diagram of the backlight unit according to the first embodiment.

FIG. 3 is a light emission waveform diagram showing an example of a wave form of (temporal variation in) an amount of light emitted by the backlight unit according to this embodiment.

As shown in FIG. 2, a backlight unit 1 includes a full-wave rectifying circuit constituted by a plurality of LEDs 11 connected so as to emit light regardless of whether an applied voltage is positive or negative and a load resistor 12.

In the example shown in FIG. 2, a plurality of LEDs (a positive light emitting row) connected in series so as to emit light when the applied voltage is positive and a plurality of LEDs (a negative light emitting row) connected in series so as to emit light when the applied voltage is negative are connected in parallel. As a result, the plurality of LEDs 11 can emit light when the applied voltage is both positive and negative.

More specifically, as shown in FIG. 3, when a momentary voltage value Vt (V) of an AC input voltage exceeds a positive side forward drop voltage value Vfp (V), a current (Ifp (A)) corresponding to a difference (|Vt(V)−Vfp (V)|) between these voltage values and a load resistance value (R (Ω)) flows through the positive light emitting row. Accordingly, the positive light emitting row emits an amount of light corresponding to the current. The AC input voltage is a voltage applied to the backlight unit 1. Further, when the momentary voltage value Vt (V) of the AC input voltage falls below a negative side forward drop voltage value Vfn (V), a current (Ifn (A)) corresponding to a difference (|Vt(V)−Vfn (V)|) between these voltage values and the load resistance value (R (Ω)) flows through the negative light emitting row. Accordingly, the negative light emitting row emits an amount of light corresponding to the current. Hence, the positive light emitting row and the negative light emitting row respectively emit light in a period of an applied alternating-current voltage.

Note that the plurality of LEDs 11 are disposed such that unevenness does not occur in a displayed video regardless of whether light is emitted by the positive light emitting row or the negative light emitting row (i.e. such that the entire backlight unit 1 emits light). Hence, in this embodiment, the entire backlight unit 1 emits light in a period corresponding to the period of the applied alternating-current voltage, or more specifically a ½ period of the alternating-current voltage.

Respective function blocks of the display apparatus shown in FIG. 1 will be described briefly below.

The backlight unit 1 is connected to an AC input unit 2.

The AC input unit 2 inputs (applies) an alternating-current voltage (the AC input voltage; a power supply voltage) into the backlight unit 1 and a phase detection unit 5.

The phase detection unit 5 detects a zero cross of the AC input voltage, and outputs a phase detection pulse at a zero cross detection timing (when a frequency of the alternating-current voltage is 50 Hz, a frequency of the phase detection pulse is 100 Hz).

A timing adjustment unit 4 adjusts a timing at which a transmittance of a liquid crystal panel 8, to be described below, changes (an adjusting unit). More specifically, the timing at which the transmittance of the liquid crystal panel 8 changes is adjusted by adjusting a timing at which an input video signal is output to a subsequent stage circuit to a timing corresponding to a read clock output by a PLL unit 3.

A frame synchronization separation unit 6 extracts a frame synchronization signal indicating a time position of a frame change from the video signal output by the timing adjustment unit 4, and outputs the extracted signal.

The PLL unit 3 compares a phase of the phase detection pulse output by the phase detection unit 5 with a phase of the frame synchronization signal output by the frame synchronization separation unit 6, and controls the read clock from the timing adjustment unit 4 such that a phase difference between the two phases remains constant (at a phase difference corresponding to a delay time D). More specifically, the frame synchronization signal output from the frame synchronization separation unit 6 is feedback-controlled to have an identical timing to a signal obtained by delaying the phase detection pulse output from the phase detection unit 5 by the delay time D in a delay unit 31.

In the timing adjustment unit 4, the timing at which the transmittance of the liquid crystal panel changes (a refresh rate) is adjusted such that a light emission period of the backlight unit 1 does not overlap an inter-frame transition period of the transmittance of the liquid crystal panel 8. Further, when a frame rate of the input video signal differs from a light emission frequency of the backlight unit 1, the frame rate of the input video signal is converted in the timing adjustment unit 4 so that the frame rate of the input video signal matches the light emission frequency of the backlight unit 1. In this embodiment, as described above, the entire backlight unit 1 emits light in a ½ period of the alternating-current voltage. Therefore, the light emission frequency of the backlight unit 1 is twice the frequency of the alternating-current voltage (i.e. when the frequency of the alternating-current voltage is 50 Hz, the light emission frequency of the backlight unit 1 is 100 Hz).

A driving unit 7 is a liquid crystal driver that controls the transmittance of the liquid crystal panel 8 by outputting a video signal corresponding to a single frame (to be referred to hereafter as display data) so as to drive the liquid crystal panel 8 frame by frame when the display data are confirmed in accordance with the video signal output by the timing adjustment unit 4.

The transmittance of liquid crystal cells constituting respective pixels of the liquid crystal panel 8 is changed to a transmittance corresponding to each frame of the input video signal. More specifically, the transmittance is increased or reduced to a transmittance corresponding to the display data output by the driving unit 7. By varying the transmittance of each R (red), G (green), and B (blue) sub pixel in accordance with the display data, a display color of each pixel is varied. Further, the liquid crystal panel 8 displays a video by transmitting light from the backlight unit 1.

Note that in this embodiment, the liquid crystal panel 8 is cited as an example, but the present invention may be applied to a panel formed from a material other than liquid crystal as long as the transmittance of the display panel can be changed.

The configuration of the PLL unit 3 shown in FIG. 1 will be described in detail below.

The PLL unit 3 is configured as follows.

The delay unit 31 delays the phase detection pulse output by the phase detection unit 5 by the fixed time D, and outputs the delayed pulse. The delay time D is set in advance such that the light emission waveform of the backlight and the transition period of the liquid crystal panel do not overlap. The delay time D is set at an appropriate value in advance through simulations and the like, and stored in a memory of the delay unit 31 prior to product shipping. The delay time D may be changed according to whether a frequency of an alternating current power supply is 50 Hz or 60 Hz.

A phase comparison unit 32 compares a phase (a reference phase) of the phase detection pulse delayed by the fixed time D and output by the delay unit 31 with the phase of the frame synchronization signal output by the frame synchronization separation unit 6, and outputs a phase difference signal corresponding to a phase difference between the two. More specifically, a positive voltage value corresponding to the phase difference is output when the phase of the frame synchronization signal is delayed relative to the reference phase of the pulse signal output from the delay unit 31, and a negative voltage value corresponding to the phase difference is output when the phase of the frame synchronization signal is advanced relative to the reference phase of the pulse signal.

A clock generation unit 33 generates, as the read clock of the timing adjustment unit 4, a clock signal having a frequency and a phase corresponding to the phase difference signal output by the phase comparison unit 32. More specifically, when a phase difference signal having a positive voltage value is output, the frequency of the read clock is increased, and when a phase difference signal having a negative voltage value is output, the frequency of the read clock is reduced. The read clock is used to read a plurality of pixel data constituting frame data. For example, when pixel data corresponding to h×n pixels exist in a single frame (horizontal pixel number: h, vertical line number: n), pulse signals are output in a number (h×n) corresponding to the data of the single frame as the read clock. When the frame data of a single frame are output from a reading unit 44, the frame synchronization separation unit 6 detects a frame change and outputs a frame synchronization signal indicating the time position of the frame change.

As described above, a frame frequency of the frame data read by the reading unit 44 is set at double the frequency of the alternating-current voltage input from the AC input unit 2 on the basis of the clock signal generated by the clock generation unit 33. For example, when the frequency of the alternating-current voltage is 50 Hz, the frame frequency of the video signal is 100 Hz (the frame rate is 100 fps). This feedback control executed by the PLL unit 3 will be described below using FIG. 6.

The PLL unit 3 configured as described above controls a video signal output timing of the timing adjustment unit 4 by varying an output timing of the read clock. As a result, the phase difference between the phase detection pulse output by the phase detection unit 5 and the frame synchronization signal output by the frame synchronization separation unit 6 is fixed.

The configuration of the timing adjustment unit 4 shown in FIG. 1 will now be described in detail.

The timing adjustment unit 4 is configured as follows.

A first frame memory 41 and a second frame memory respectively store a video signal (frame data) corresponding to a single frame.

A writing unit 43 writes the input video signal into the first frame memory 41 and the second frame memory 42 alternately, frame by frame. The frame data are written in synchronization with the input video signal. For example, when the frame rate of the input video signal is 60 fps, frame data writing is performed every 16.7 ms.

The reading unit 44 selects either the first frame memory 41 or the second frame memory 42 in response to output of the read clock from the PLL unit 3, reads the frame data from the selected frame memory, and outputs the read frame data as an output video signal. As a result, the frame data are read in synchronization with a zero cross phase of the AC input voltage. For example, in a region where the frequency of the AC input voltage is 50 Hz, the frame data are read every 10 ms, and in a region where the frequency of the AC input voltage is 60 Hz, the frame data are read every 8.3 ms. The frame memory is selected in accordance with an output of a control unit 45.

The control unit 45 controls frame memory selection by the reading unit 44 to ensure that overtaking does not occur between frame data reading by the reading unit 44 and frame data writing by the writing unit 43.

Note that in this embodiment, frame memory selection by the reading unit 44 is controlled, but frame memory selection by the writing unit 43 may be controlled instead.

An example of a processing flow of the timing adjustment unit 4 will now be described using FIGS. 4A and 4B.

Figure 4A:
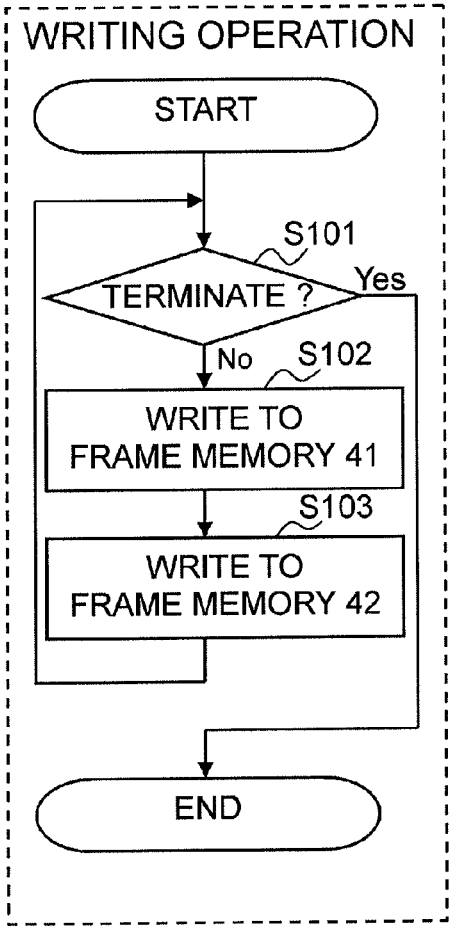
FIGS. 4A and 4B are flowcharts showing processing executed by a timing adjustment unit according to the first embodiment.

A writing operation (frame data writing to the frame memories by the writing unit 43) shown in FIG. 4A is started using the introduction of a power supply or the like as a trigger.

A flow of the writing operation will now be described.

First, the control unit 45 determines whether or not a user has issued a power supply OFF instruction (S101: termination determination).

When it is determined in S101 that a power supply OFF instruction has been issued, the writing operation is terminated. When it is determined that a power supply OFF instruction has not been issued, the writing unit 43 writes a frame 0 (a first frame) of the input video signal to the first frame memory 41 (S102: first frame writing processing). Next, the writing unit 43 writes a frame 1 to the second frame memory 42 (S103: second frame writing processing).

The processing of S101 to S103 is repeated similarly thereafter. More specifically, the processing of S101 is repeated, and when a power supply OFF instruction has not been issued, a frame 2 of the input video signal is overwritten to the first frame memory 41 (S102), whereupon a frame 3 is overwritten to the second frame memory 42 (S103).

Thus, the frame data of frame 0, frame 1, frame 2, frame 3, . . . , frame n input in sequence are stored alternately in the two frame memories. Hence, until the user issues a power supply OFF instruction, frame data not being written are held for at least one frame at all times.

Figure 4B:
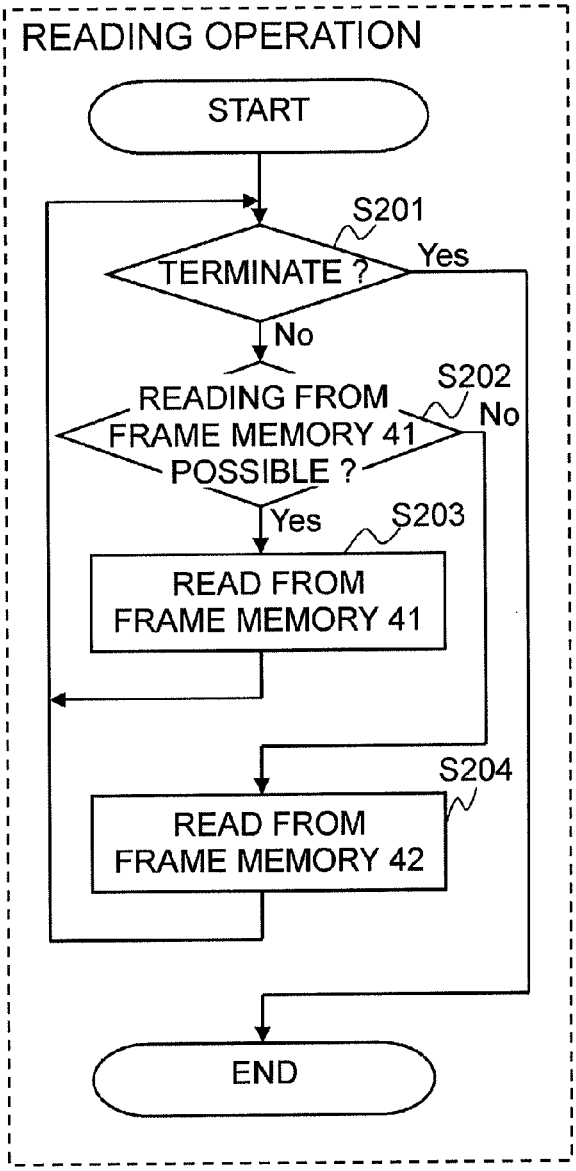

A reading operation (frame data reading from the frame memories by the reading unit 44) shown in FIG. 4B is started using the introduction of a power supply or the like as a trigger.

A flow of the reading operation will now be described.

First, the control unit 45 determines whether or not the user has issued a power supply OFF instruction (S201: termination determination).

When it is determined in S201 that a power supply OFF instruction has been issued, the reading operation is terminated. When it is determined that a power supply OFF instruction has not been issued, the control unit 45 determines whether or not incomplete frame data (an incomplete frame) are to be read from the first frame memory 41 by the reading unit 44 (S202: overtaking determination). Note that incomplete frame data are read when reading from the first frame memory 41 by the reading unit 44 overtakes the first frame writing processing (S102) executed by the writing unit 43. The control unit 45 may perform the overtaking determination on the basis of whether or not reading from the first frame memory 41 by the reading unit 44 starts in a condition where the writing processing to the first frame memory 41 executed by the writing unit 43 is at least halfway complete. When reading from the first frame memory 41 by the reading unit 44 starts in a condition where the writing processing to the first frame memory 41 executed by the writing unit 43 is at least halfway complete, it is determined that incomplete frame data (an incomplete frame) will not be read. By learning a time required for the writing processing to the frame memory in advance, the overtaking determination can be performed through calculation processing from a writing start time to the frame memory and a reading start time from the frame memory.

When it is determined in S202 that complete frame data can be read from the first frame memory 41, the reading unit 44 reads the frame data from the first frame memory 41 and outputs the read frame data (S203: first frame memory reading processing). When it is determined that incomplete frame data are to be read, the reading unit 44 reads the frame data from the second frame memory 42 and outputs the read frame data (S204: second frame memory reading processing).

The processing of S201 to S204 is repeated similarly thereafter. More specifically, the processing of S201 is repeated, and when a power supply OFF instruction has not been issued, frame data are read from the frame memory of the two frame memories from which complete frame data can be read. The read frame data are then output.

Hence, when overtaking occurs, the frame rate of the input video signal is converted by reading and outputting identical frame data continuously from the same frame memory. In other words, the frame rate of the input video signal is converted by reading and outputting frame data from the frame memory of the two frame memories from which complete frame data can be read.

Figure 5:
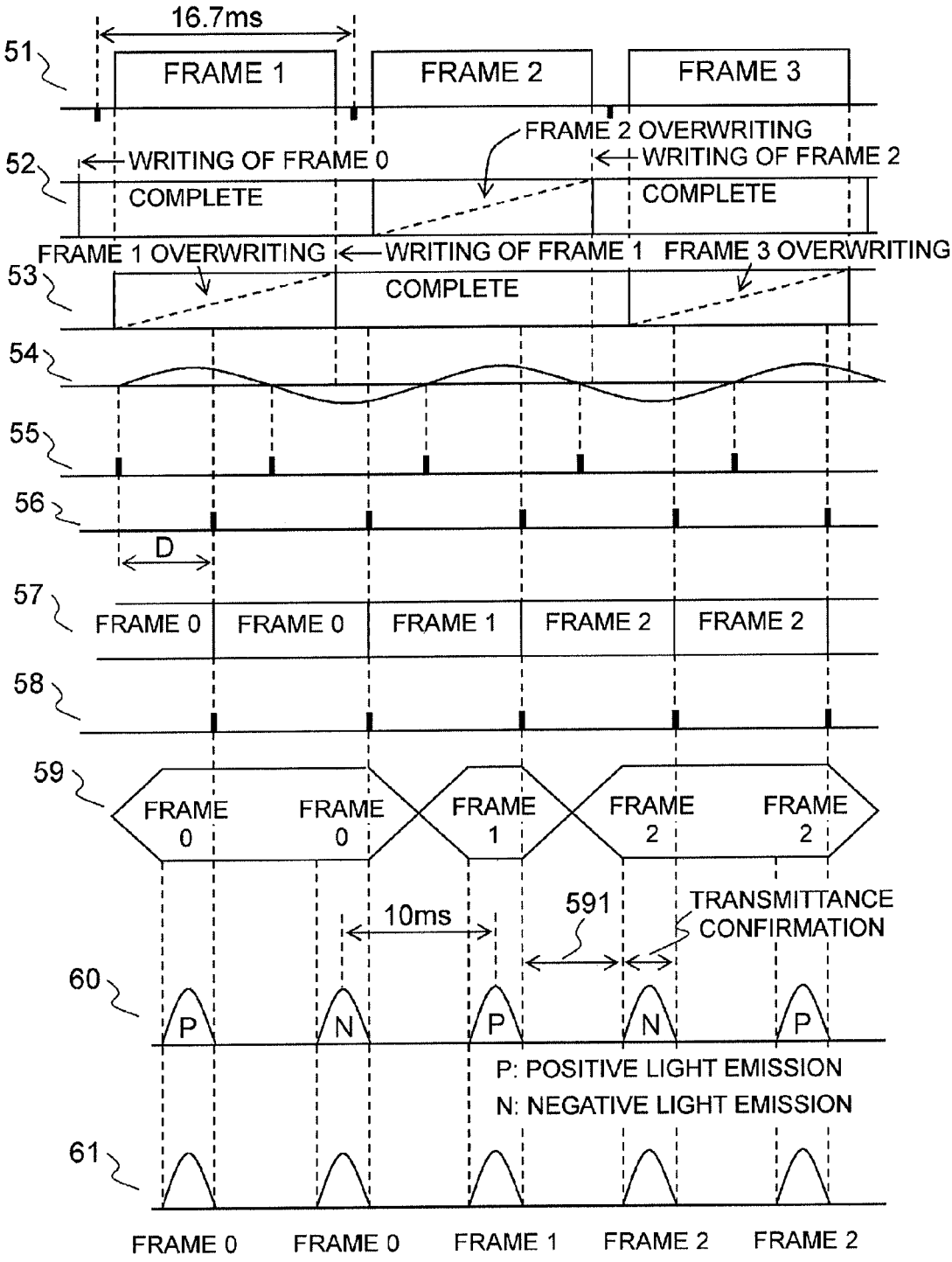
FIG. 5 is a wave form diagram illustrating an operation of the display apparatus according to the first embodiment.

An operation of the display apparatus according to this embodiment will now be described in detail using FIG. 5. FIG. 5 shows an example of respective waveforms of the display apparatus according to this embodiment.

In FIG. 5, the frame rate of an input video signal 51 is 60 fps, and therefore the frame data are input every 16.7 ms.

An AC input voltage 54 is not synchronous with the input video signal 51, and a frequency thereof is 50 Hz.

Frame data 52 stored in the first frame memory 41 are data of even-numbered frames of the input video signal (the frame 0, the frame 2, a frame 4 (not shown), . . . , the frame n). Frame data 53 stored in the second frame memory 42 are data of odd-numbered frames of the input video signal (the frame 1, a frame 3, a frame 5 (not shown), . . . , a frame (n+1)). The first frame memory 41 enter a frame data overwriting condition during frame data writing, and complete frame data cannot be read from the first frame memory 41 until overwriting of the frame data is complete. The second frame memory 42 also enter a frame data overwriting condition during frame data writing, and complete frame data cannot be read from the second frame memory 42 until overwriting of the frame data is complete.

The reading timing from the frame memory is controlled by the PLL unit 3 such that a phase of a delay output 56 and a phase of a frame synchronization output 58 are identical. The delay output 56 is a signal (an output pulse signal of the delay unit 31) obtained by delaying a phase detection pulse 55 (the output pulse signal from the phase detection unit 5) indicating the zero cross timing of the AC input voltage 54 by the delay time D. The frame synchronization output 58 is a signal (the output signal of the frame synchronization separation unit 6) indicating the timing of a frame change in the output video signal. As a result of the control described above, a phase difference between the phase detection pulse 55 and the frame synchronization output 58 is fixed (at the delay time D).

Frame data 57 are frame data which are read from the frame memory selected according to the overtaking determination (S202) of the control unit 45. That is, the frame data 57 are frame data which are read from the frame memory which can be overwritten completely before reading is complete, and in which overtaking will not occur. The reading unit 44 reads the frame data 57 from the frame memory and outputs the read frame data 57 as the output video signal simultaneously.

Figure 6:
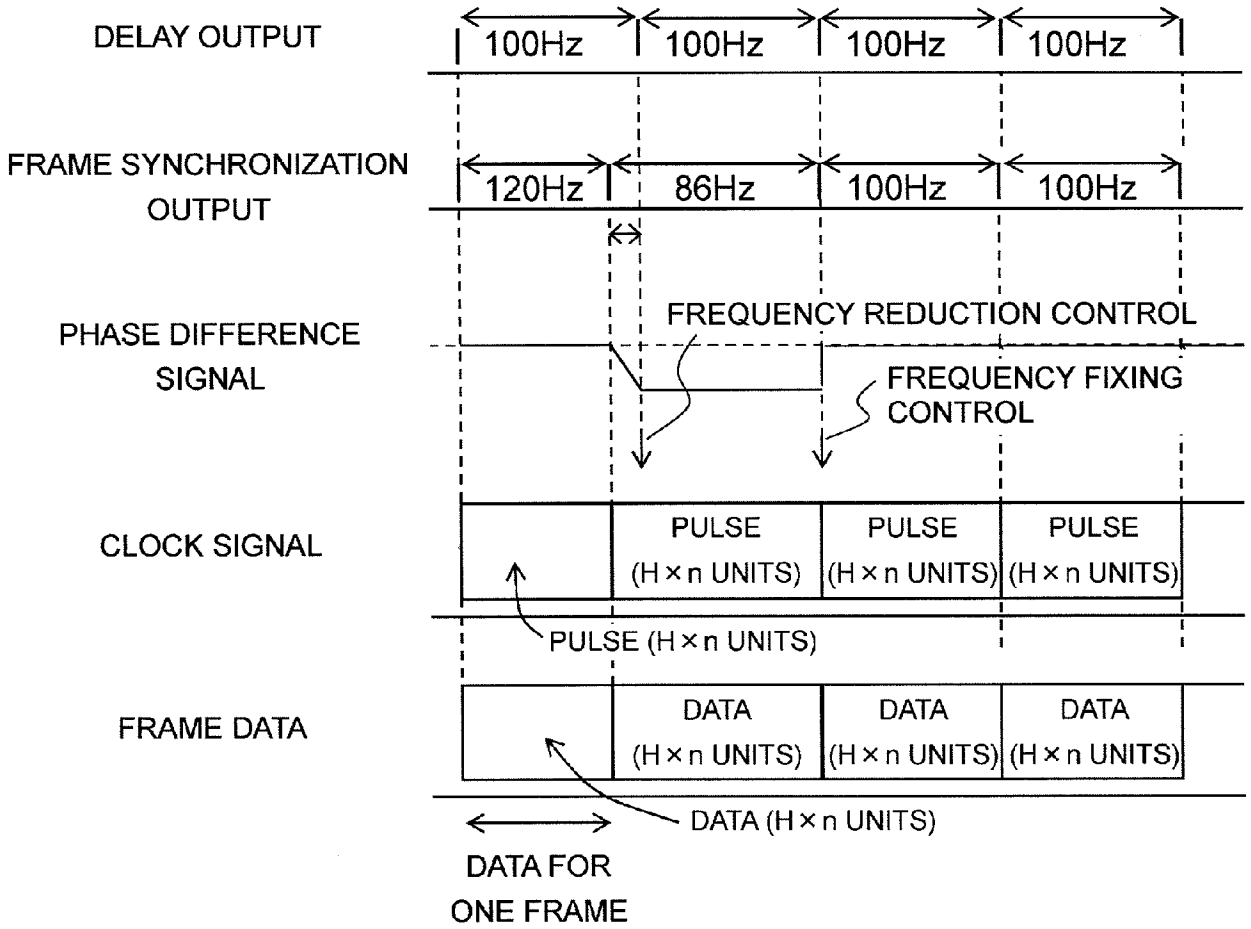
FIG. 6 is a wave form diagram illustrating an operation of a PLL unit.

FIG. 6 shows the manner in which the phase of the output signal from the frame synchronization separation unit 6 is adjusted to match the phase of the output pulse signal from the delay unit 31 in the feedback control performed by the PLL unit 3. When the frequency of the alternating-current voltage is 50 Hz, the frequency of the phase detection pulse output from the phase detection unit 5 is 100 Hz. The phase detection pulse signal output from the phase detection unit 5 is delayed by the delay time D in the delay unit 31.

When, in an initial condition, the read clock output from the clock generation unit 33 corresponds to frame data of 120 fps, the frame synchronization signal output from the frame synchronization separation unit 6 is 120 Hz. When the frame rate of the video signal input into the timing adjustment unit 4 is 60 fps, the timing adjustment unit 4 converts the frame rate from 60 fps to 120 fps. At this time, the phase of the frame synchronization signal is advanced relative to the reference phase of the pulse signal output from the delay unit 31 by an amount corresponding to a difference between a period of the pulse signal and a period of the frame synchronization signal. Therefore, the phase comparison unit 32 outputs a phase difference signal having a negative voltage value corresponding to this difference (the phase difference).

The clock generation unit 33 reduces the frequency of the read clock from 120 Hz to 86 Hz in accordance with the value (voltage value) of the phase difference signal output from the phase comparison unit 32. In other words, the period of the read clock is lengthened by an amount of time corresponding to twice the difference (1.67 ms) between the reference phase and the phase of the frame synchronization signal. At this time, the clock generation unit 33 determines that the frequency of the phase detection pulse is 100 Hz from the value of the phase difference signal output from the phase comparison unit 32. Next, the clock generation unit 33 increases the frequency of the read clock by 14 Hz so as to output a read clock corresponding to frame data of 100 fps. Hence, on the basis of the clock signal generated by the clock generation unit 33, the frame frequency of the frame data read by the reading unit 44 is twice (100 Hz) the frequency of the alternating-current voltage input from the AC input unit 2.

Note, however, that the feedback control method used by the PLL unit 3 is not limited to the method described using FIG. 6, and as long as the phases of the output pulse signal from the delay unit 31 and the output signal from the frame synchronization separation unit 6 can be aligned, another typical feedback control method may be used. For example, the clock generation unit 33 may cause the phase of the frame synchronization signal to approach the reference phase gradually. More specifically, the clock generation unit 33 may perform processing repeatedly in which whether the phase of the frame synchronization signal is delayed or advanced relative to the reference phase (i.e. whether the phase difference signal is positive or negative) is determined, and the frequency of the read clock is increased or reduced by a predetermined value (2 Hz, for example) in accordance with the determination result. The aforesaid predetermined value may be changed in accordance with the difference between the reference phase and the phase of the frame synchronization signal.

The driving unit 7 confirms a video signal (display data) for a single frame when an output video signal corresponding to a single frame is input from the reading unit 44, and drives the liquid crystal panel 8 frame by frame in accordance with the display data. Therefore, when the confirm display data are identical to the display data of a previous frame, a transmittance 59 of the liquid crystal panel 8 remains unchanged, but when the confirmed display data differ from the display data of the previous frame, the transmittance 59 changes to a value corresponding to the confirmed display data through a transition period 591 indicated by shading in FIG. 5. In the transition period 591, the transmittance of the liquid crystal panel 8 is in a transitional condition between two values corresponding to the two sets of different display data, and if the backlight unit 1 is illuminated during this period, a double image consisting of the two sets of display data (two frames) is displayed. Note that a response time of liquid crystal typically differs between a case in which "black" changes to "white" or "white" changes to "black" and a case in which "black" changes to "gray" or "gray" changes to "black". The response time of liquid crystal is also not constant in relation to colors other than monochrome. The transition period 591 according to the present invention may be as a transition period for a case in which "black" changes to "white" (or "white" changes to "black"), and may be a transition period for a case in which "black" changes to "gray" or "gray" changes to "black", and so on. Further, in actuality, the transmittance of the liquid crystal does not vary linearly over time, as shown in FIG. 5, but forms a saturation curve that varies nonlinearly. The transition period 591 is a period required for the transmittance to reach a level of 90% of a desired value, for example, and in the example shown in FIG. 5, the transition period 591 is 7 ms.

In this embodiment, a frequency of a light emission waveform 60 of the backlight unit 1 and the frame rate of the output video signal (display data groups for driving the liquid crystal panel 8) are equal (both being twice the frequency of the AC input voltage 54). The delay time D of the delay unit 31 is set such that the light emission waveform 60 and the transition period 591 of the liquid crystal panel 8 do not overlap. Hence, the backlight unit 1 is illuminated during a period in which the transmittance of the liquid crystal panel 8 is confirmed (a period in which the transmittance is the transmittance corresponds to the display data has been input), and as a result, as shown by a video display waveform 61, a video is displayed in a period that does not overlap the transition period 591.

According to this embodiment, as described above, in a configuration for subjecting the light source of the backlight unit to alternating current driving, the timing at which the transmittance of the liquid crystal panel changes is adjusted so that the light emission period of the backlight unit and the inter-frame transition period of the transmittance of the liquid crystal panel do not overlap. As a result, a sharp video can be displayed with low power consumption. More specifically, display of a double image consisting of two frames can be suppressed, and as a result, so-called motion blurring occurring during display of a moving image can be suppressed.

Further, according to this embodiment, when the frame rate of the input video signal differs from the light emission frequency of the backlight unit, the frame rate of the input video signal is converted to match the light emission frequency of the backlight unit. In so doing, actions and effects corresponding to the actions and effects described above can be obtained even when the frame rate of the input video signal differs from the light emission frequency of the backlight unit.

Note that in this embodiment, the timing at which the transmittance of the liquid crystal panel changes is adjusted so that the light emission period of the backlight unit and the inter-frame transition period of the transmittance of the liquid crystal panel do not overlap. However, a small part of the respective periods may overlap. More specifically, it is sufficient to ensure that a timing at which a light emission amount of the backlight unit reaches a peak during the light emission period and the inter-frame transition period of the transmittance of the liquid crystal panel do not overlap. Likewise in this case, a moving image blurring suppression effect is obtained to a certain degree.

Furthermore, in this embodiment, the frame rate of the input video signal is invariably converted when the frame rate of the input video signal differs from the light emission frequency of the backlight unit. In place of this configuration, however, when the frame rate of the input video signal is an integer fraction of the light emission frequency of the backlight unit, for example, the timing at which the transmittance of the liquid crystal panel changes may be adjusted alone, without converting the frame rate.

Moreover, in this embodiment, the frame rate of the input video signal is aligned with the light emission frequency of the backlight unit when the frame rate of the input video signal differs from the light emission frequency of the backlight unit. In place of this configuration, however, when the frame rate of the video signal is not an integer fraction of the light emission frequency of the backlight unit, the frame rate of the video signal may be converted to an integer fraction of the light emission frequency of the backlight unit.

In this embodiment, the delayed phase detection pulse and the frame synchronization signal are compared, and the output timing of the read clock is determined in accordance with the phase difference therebetween. In place of this configuration, however, the aforesaid comparison may be omitted and the output timing of the read clock may be determined in accordance with the phase detection pulse alone, for example.

Further, a determination unit for determining the frame rate of the video signal may be provided before the timing adjustment unit 4 such that the PLL unit 3 and the timing adjustment unit 4 are operated only when the frame rate of the input video signal differs from the light emission frequency of the backlight unit.

Furthermore, an interpolation frame generation unit for generating an interpolation frame from two consecutive frames of the video signal may be provided (the control unit 45 may be configured to include an inbuilt interpolation frame generation unit). An interpolation frame may be generated from two consecutive frames using a method such as calculating an average value of pixel values of identically positioned pixels of the two frames and setting the average value as a pixel value of the interpolation frame. In this case, with reference to FIG. 5, the frame 0 immediately preceding the frame 1 is replaced with an interpolation frame generated from the frame 0 and the frame 1, and the frame 2 immediately following the frame 1 is replaced with an interpolation frame generated from the frame 1 and the frame 2.

Second Embodiment

A display apparatus and a control method thereof according to a second embodiment of the present invention will be described below.

A functional configuration of the display apparatus according to this embodiment is similar to that of the first embodiment (FIG. 1). Function blocks that perform identical operations to the first embodiment will be omitted from the following description, and function blocks that perform different operations to the first embodiment will be described using FIG. 1.

The phase detection unit 5 detects the zero cross at which the alternating-current voltage input from the AC input unit 2 varies from negative to positive, and outputs the phase detection pulse at the zero cross detection timing.

The liquid crystal panel 8 is driven in line sequence by display data from a first line in a screen uppermost portion to an nth line (where n is in integer of 3 or more) in a screen lowermost portion so as to display a video of a single frame. Hereafter, a line in a screen center portion will be described as an mth line (where m is an integer larger than 1 and smaller than n).

The driving unit 7 drives the liquid crystal panel 8 in line sequence, line by line, by outputting a video signal (to be referred to hereafter as display data) for a single line of a single frame thereto after confirming the display data from the video signal output by the timing adjustment unit 4.

The backlight unit 1 includes a positive light emission region 13 and a negative light emission region 14. The positive light emission region 13 is a region provided with a light source that emits light when the alternating-current voltage from the AC input unit 2 is positive, and the positive light emitting row of the plurality of LEDs 11 is disposed therein. The negative light emission region 14 is a region provided with a light source that emits light when the alternating-current voltage from the AC input unit 2 is negative, and the negative light emitting row of the plurality of LEDs 11 is disposed therein. In this embodiment, a region of the backlight unit 1 corresponding to a region from the first line to the mth line, i.e. a screen upper portion of the liquid crystal panel 8, is set as the positive light emission region 13, while a region of the backlight unit 1 corresponding to a region from an m+1th line to the nth line, i.e. a screen lower portion of the liquid crystal panel 8, is set as the negative light emission region 14. The positive light emission region 13 disposed in the screen upper portion and the negative light emission region 14 disposed in the screen lower portion emit light alternately in accordance with the AC input voltage. Hence, in this embodiment, the entire backlight unit 1 emits light in the period of the alternating-current voltage.

In this embodiment, the timing at which the transmittance of a region corresponding to the positive light emission region 13 of the liquid crystal panel 8 changes is adjusted so that the light emission period of the positive light emission region 13 and the inter-frame transition period of the transmittance in the region corresponding to the positive light emission region 13 of the liquid crystal panel 8 do not overlap. Further, the timing at which the transmittance of a region corresponding to the negative light emission region 14 of the liquid crystal panel 8 changes is adjusted so that the light emission period of the negative light emission region 14 and the inter-frame transition period of the transmittance in the region corresponding to the negative light emission region 14 of the liquid crystal panel 8 do not overlap.

Figure 7:
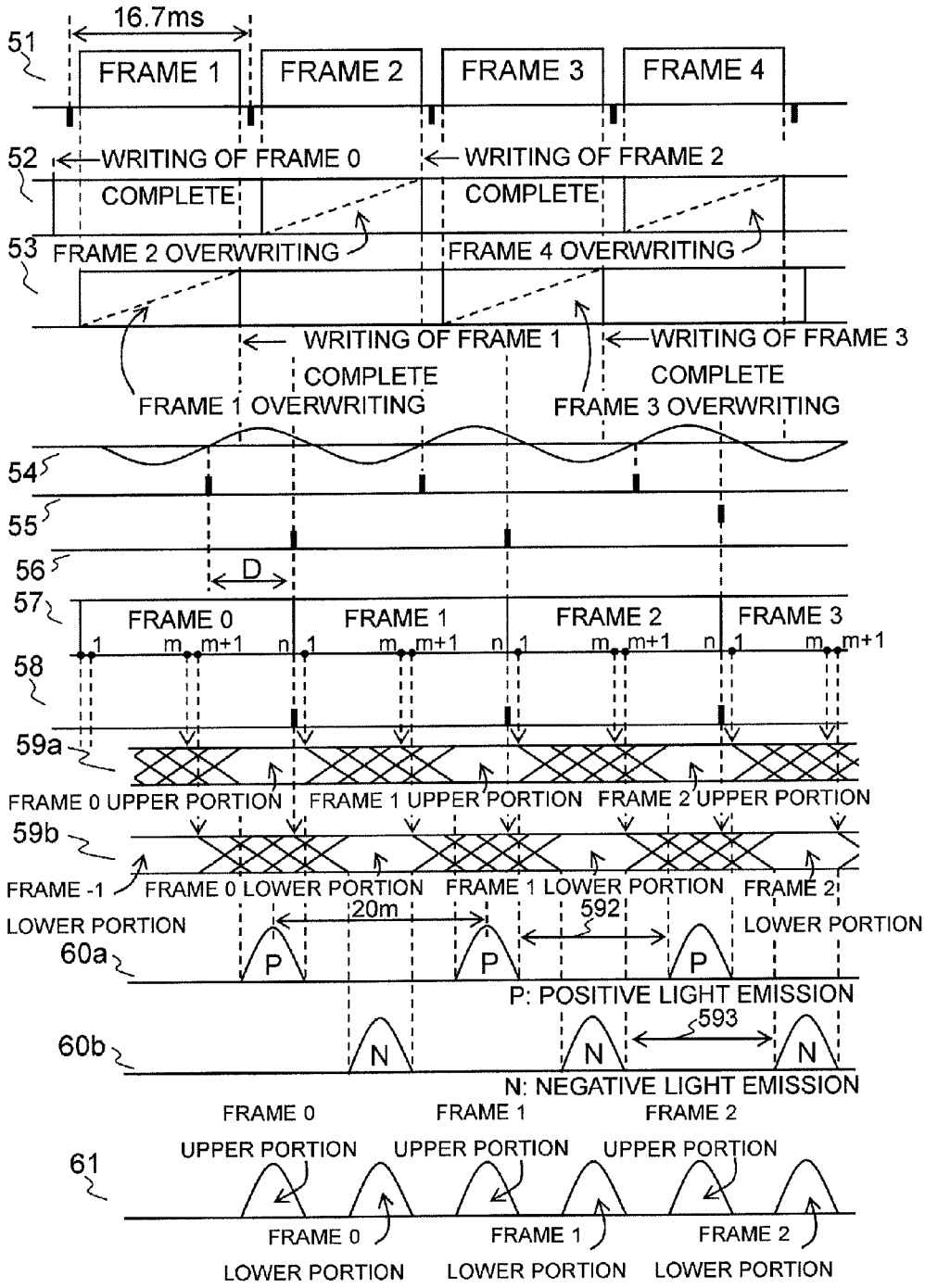
FIG. 7 is a wave form diagram illustrating an operation of the display apparatus according to the second embodiment.
Figure 8:
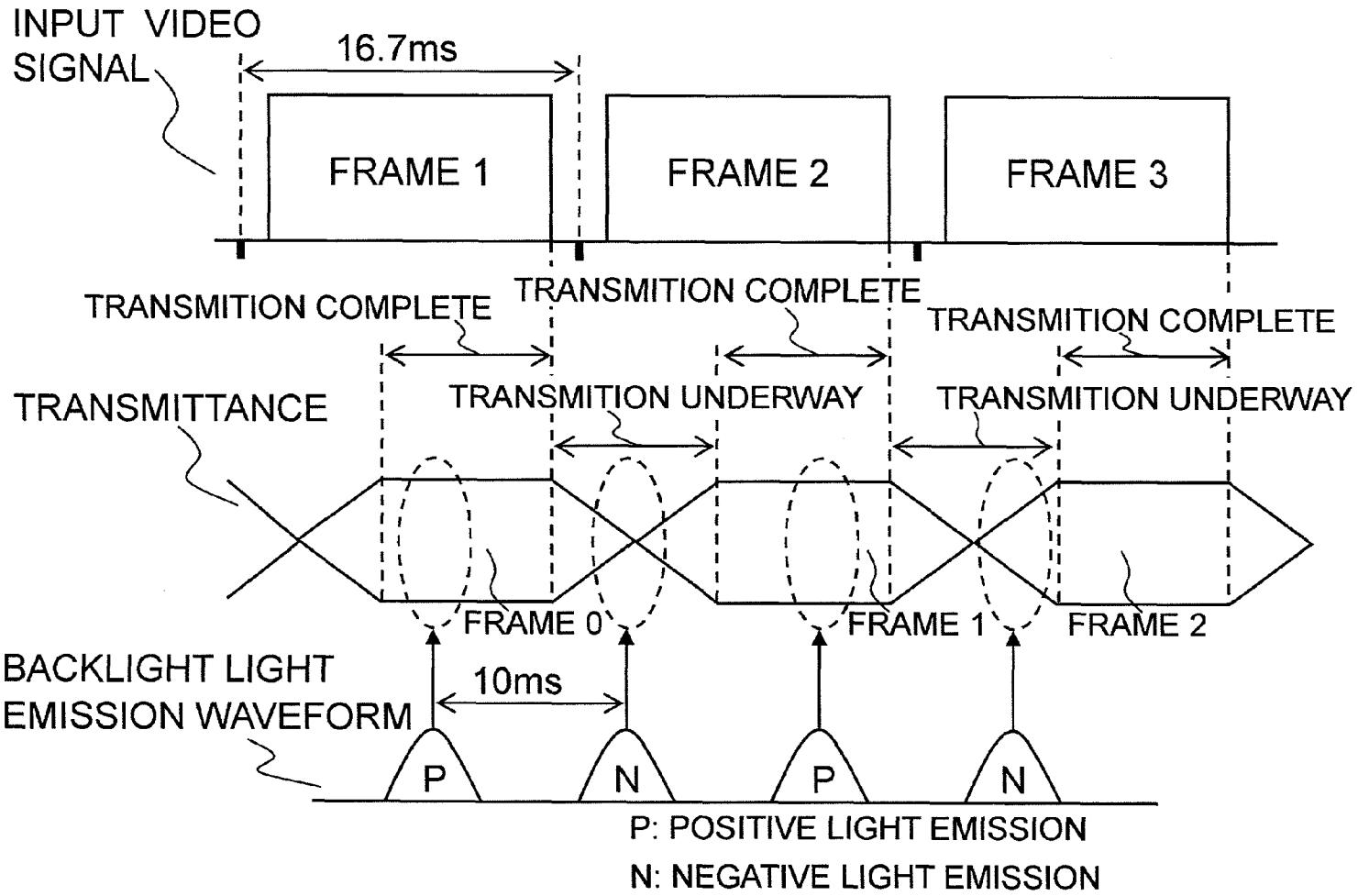
FIG. 8 (Prior Art)
FIG. 8 is a waveform diagram showing a case in which a backlight unit of a conventional display apparatus is subjected to alternating current driving.

An operation of the display apparatus according to this embodiment will be described in detail below using FIG. 7. FIG. 7 shows an example of respective waveforms in the display apparatus according to this embodiment. Note that identical waveforms to the first embodiment (the waveforms shown in FIG. 5) will be omitted from the following description, and different waveforms to the first embodiment will be described.

The read timing from the frame memory is controlled by the PLL unit 3 such that the phases of the delay output 56 and the frame synchronization output 58 are identical. The delay output 56 is a signal obtained by delaying the phase detection pulse 55 indicating the zero cross timing at which the AC input voltage 54 varies from negative to positive by the delay time D. As a result of the control described above, the phase difference between the phase detection pulse 55 and the frame synchronization output 58 is fixed (at the delay time D).

The frame data 57 are the frame data that are read using a similar method to the first embodiment. Note, however, that in this embodiment, control is performed such that the frame change occurs in synchronization with the zero cross timing at which the AC input voltage 54 varies from negative to positive. Hence, the frame data 57 (output video signal) according to this embodiment are data obtained by thinning out one of two consecutive frames from the frame data 57 according to the first embodiment (FIG. 5). In other words, the frame rate of the frame data 57 according to this embodiment is half the frame rate of the first embodiment.

Note that reading of the frame data 57 for a single frame starts from the first line in the screen uppermost portion of the liquid crystal panel 8 and ends at the nth line in the screen lowermost portion. Reading of the frame data for the next frame starts in the meantime.

The driving unit 7 confirms the video signal (display data) for a single line when an output video signal corresponding to a single line is input from the reading unit 44, and drives the liquid crystal panel 8 line by line using the display data. Therefore, when the confirmed display data are identical to the display data for the same line of the previous frame, a transmittance 59*a* of the first to mth lines of the liquid crystal panel 8 remains unchanged. When the confirmed display data differ from the display data for the same line of the previous frame, the transmittance 59*a* changes to a value corresponding to the confirmed display data through a transition period 592 of the first to mth lines, indicated by a plurality of diagonal lines in FIG. 7. In the transition period 592 of the first to mth lines, the transmittance of the liquid crystal panel 8 is in a state of transition between two values corresponding to the two different sets of display data, and therefore, if the positive light emission region 13 of the backlight unit 1 is illuminated in this period, a double image consisting of the two sets of display data (two frames) is displayed. Similarly to the transmittance 59*a* of the first to mth lines, a transmittance 59*b* of the m+1th to nth lines changes to a value corresponding to the confirmed display data through a transition period 593 of the m+1th to nth lines when the confirmed display data differ from the display data for the same line of the previous frame.

In this embodiment, the frequency of the light emission waveform of the backlight unit 1 (the frequency of a light emission waveform 60*a* in the screen upper portion of the backlight unit 1 and the frequency of a light emission waveform 60*b* in the screen lower portion) is equal to the frame rate of the output video signal (the display data groups for driving the liquid crystal panel 8). More specifically, the aforesaid frequencies are identical to the frequency of the AC input voltage 54. The delay time D of the delay unit 31 is set such that the light emission waveform 60*a* does not overlap the transition period 592 of the first to mth lines of the liquid crystal panel 8 and such that the light emission waveform 60*b* does not overlap the transition period 593 of the m+1th to nth lines of the liquid crystal panel 8. Hence, the positive light emission region 13 of the backlight unit 1 is illuminated during the period in which the transmittance of the first to mth lines of the liquid crystal panel 8 is confirmed, whereby the video of the screen upper portion is displayed in a period that does not overlap the transition period 592, as shown by the video display waveform 61. Further, the negative light emission region 14 of the backlight unit is illuminated during the period in which the transmittance of the m+1th to nth lines of the liquid crystal panel 8 is confirmed, whereby the video of the screen lower portion is displayed in a period that does not overlap the transition period 593, as shown by the video display waveform 61.

According to this embodiment, as described above, the timing at which the transmittance of the region corresponding to the positive light emission region of the liquid crystal panel changes is adjusted such that the light emission period of the positive light emission region and the inter-frame transition period of the transmittance in the region corresponding to the positive light emission region of the liquid crystal panel do not overlap. Further, the timing at which the transmittance of the region corresponding to the negative light emission region of the liquid crystal panel changes is adjusted such that the light emission period of the negative light emission region and the inter-frame transition period of the transmittance in the region corresponding to the negative light emission region of the liquid crystal panel do not overlap. As a result, a sharp video can be displayed with low power consumption. More specifically, display of a double image consisting of two frames can be suppressed, and as a result, so-called motion blurring occurring during display of a moving image can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-098098, filed on Apr. 26, 2011, and Japanese Patent Application No. 2012-013162, filed on Jan. 25, 2012, which are hereby incorporated by reference herein in their entirety.

What is claimed is:

1. A display apparatus comprising:

a display panel having a transmittance that can be changed for each frame of an input video signal;

an adjusting unit that adjusts a timing at which the transmittance of the display panel changes on a basis of a period of an alternating-current voltage; and a backlight unit that emits light in a period corresponding to the period of the applied alternating-current voltage, wherein the backlight unit includes:

a positive light emission region provided with a light source that emits light when a value of the alternating-current voltage is positive; and a negative light emission region provided with a light source that emits light when the value of the alternating-current voltage is negative, and the adjusting unit adjusts a timing at which the transmittance of the display panel in a region corresponding to the positive light emission region changes such that a light emission period of the positive light emission region does not overlap an inter-frame transition period of the transmittance of the display panel in the region corresponding to the positive light emission region, and adjusts a timing at which the transmittance of the display panel in a region corresponding to the negative light emission region changes such that a light emission period of the negative light emission region does not overlap an inter-frame transition period of the transmittance of the display panel in the region corresponding to the negative light emission region.

2. The display apparatus according to claim 1, wherein the adjusting unit adjusts the timing at which the transmittance of the display panel changes such that a timing at which a light emission amount reaches a peak within a light emission period of the backlight unit does not overlap an inter-frame transition period of the transmittance of the display panel.

3. The display apparatus according to claim 1, wherein, when a frame rate of the video signal is not an integer fraction of a light emission frequency of the backlight unit, the adjusting unit converts the frame rate of the video signal such that the frame rate of the video signal is an integer fraction of the light emission frequency of the backlight unit.

4. The display apparatus according to claim 1, wherein the display panel is a liquid crystal panel.

5. A control method for a display apparatus that includes a display panel, and a backlight unit that emits light in a period corresponding to a period of an applied alternating-current voltage, the control method comprising the steps of:

changing, for each frame of an input video signal, a transmittance of the display panel to a transmittance corresponding to the frame; and adjusting a timing at which the transmittance of the display panel changes on a basis of the period of the alternating-current voltage, wherein the backlight unit includes:

a positive light emission region provided with a light source that emits light when a value of the alternating-current voltage is positive; and a negative light emission region provided with a light source that emits light when the value of the alternating-current voltage is negative, and in the step of adjusting, a timing at which the transmittance of the display panel in a region corresponding to the positive light emission region changes is adjusted such that a light emission period of the positive light emission region does not overlap an inter-frame transition period of the transmittance of the display panel in the region corresponding to the positive light emission region, and a timing at which the transmittance of the display panel in a region corresponding to the negative light emission region changes is adjusted such that a light emission period of the negative light emission region does not overlap an inter-frame transition period of the transmittance of the display panel in the region corresponding to the negative light emission region.

6. The method according to claim 5, wherein in the step of adjusting, the timing at which the transmittance of the display panel changes is adjusted such that a timing at which a light emission amount reaches a peak within a light emission period of the backlight unit does not overlap an inter-frame transition period of the transmittance of the display panel.

7. The method according to claim 5, wherein, when a frame rate of the video signal is not an integer fraction of a light emission frequency of the backlight unit, in the step of adjusting, the frame rate of the video signal is converted such that the frame rate of the video signal is an integer fraction of the light emission frequency of the backlight unit.

8. The method according to claim 5, wherein the display panel is a liquid crystal panel.

* * * * *